United States Patent [19]

Leigh et al.

[11] Patent Number: 4,927,061

[45] Date of Patent: May 22, 1990

[54] DISPENSING VALVE WITH ELASTIC SEALING TUBE

[75] Inventors: James P. Leigh; Henry G. Roethel, both of Ravenna, Ohio

[73] Assignee: The Meyer Company, Cleveland, Ohio

[21] Appl. No.: 247,733

[22] Filed: Sep. 22, 1988

[51] Int. Cl.[5] ..... B65D 37/00

[52] U.S. Cl. ..... 222/212; 222/214; 222/528; 222/556; 137/801; 251/9

[58] Field of Search ..... 222/206, 209, 212, 213, 222/214, 517, 556, 494, 542, 512, 511, 469, 472, 528; 137/860, 801; 251/9, 349

[56] References Cited

U.S. PATENT DOCUMENTS

| | | | |
|---|---|---|---|
| 2,014,881 | 9/1935 | Carlstrom | 222/494 |
| 2,021,731 | 11/1935 | Leins . | |
| 3,151,787 | 10/1964 | Miller | 222/542 X |
| 3,168,226 | 2/1965 | Underwood et al. | 222/472 |
| 3,195,573 | 7/1965 | Daumy . | |
| 3,400,866 | 9/1968 | Fattori . | |
| 3,416,567 | 12/1968 | Von Dardel et al. . | |
| 3,434,695 | 3/1969 | Green . | |
| 3,443,728 | 5/1969 | Scholle . | |
| 3,464,446 | 9/1969 | Jaffier | 137/801 X |
| 3,690,344 | 9/1972 | Brumm . | |
| 4,099,651 | 7/1978 | von Winckelmann | 222/494 X |
| 4,169,548 | 10/1979 | Bond | 222/511 X |
| 4,275,765 | 6/1981 | Dugas . | |
| 4,621,750 | 11/1986 | Roethel . | |

*Primary Examiner*—Kevin P. Shaver
*Assistant Examiner*—Gregory L. Huson
*Attorney, Agent, or Firm*—Fay, Sharpe, Beall, Fagan, Minnich & McKee

[57] ABSTRACT

A dispensing valve comprises a first body portion having a connecting assembly for joining to a fluid outlet. A second body portion comprises a relatively rigid, elongated member having a lateral side wall terminating in a free end. A discharge orifice is formed in the lateral side wall of the second body portion. Mounted on the second body portion in tightly encircling relationship to sealingly overlie the discharge orifice and prevent fluid flow therethrough is a resilient tubular member. An operating handle is joined to the tubular member for selectively and resiliently deflecting the tubular member away from the discharge orifice to permit flow therethrough.

4 Claims, 3 Drawing Sheets

DISPENSING VALVE WITH ELASTIC SEALING TUBE

BACKGROUND OF THE INVENTION

The subject invention is directed toward the valve art and, more particularly, to a dispensing valve assembly.

The invention is especially suited for use as a dispensing valve on bag-in-the-box or membrane type beverage containers and and will be described with particular reference thereto; however, as will become apparent, the invention is capable of broader application and could be used in many different environments for a variety of purposes.

In the commonly assigned U.S. Pat. No. 4,621,750 issued Nov. 11, 1986 for "Dispenser Valve", there is disclosed a valve intended for dispensing fluid products which generally comprises a tubular discharge nozzle or passageway having a longitudinal bore which communicates with an inlet passage through a port in its side wall. A valve element in the form of a resilient tube is located within the tubular discharge nozzle. The valve element is compressed and interference fitted within the nozzle and seals about the port. The valve element is moved between open and closed positions by a handle assembly which pivots to selectively shift the valve element away from the port to permit flow therethrough.

The noted valve is relatively inexpensive to manufacture and is highly reliable in operation. In addition, the valve is capable of undergoing an extremely high number of cycles without leaking.

One disadvantage of the noted valve is that it is somewhat difficult to assemble and disassemble. Specifically, difficulties are sometimes encountered during manufacture in properly placing and locating the resilient tube within the discharge passageway. Likewise, removal of the tube for replacement is also a problem.

A further difficulty with the prior valve is that under certain conditions it has a less than desirable rate of flow. That is, it would be preferably if the valve could accommodate a greater flow rate without requiring increasing the overall size of the valve.

Accordingly, it has been considered desirable to develop a new and improved dispensing valve assembly which would overcome the above discussed problems and others while providing improved overall functioning and results.

BRIEF SUMMARY OF THE INVENTION

In accordance with the present invention, a new and significantly improved valve apparatus is provided which is simple to manufacture and repair and which is highly reliable in operation.

More particularly, in accordance with the invention, the valve includes a first body portion having connecting means for joining the body portion to a fluid outlet. A second body portion comprising a relatively rigid, elongated member extends from the first body portion. The relatively rigid member has a lateral sidewall and terminates in a free end portion. A discharge orifice is formed in the lateral sidewall of the second body portion and a fluid passageway means extends through the first and second body portions for providing fluid communication from the fluid outlet to the discharge orifice. Mounted on the second body portion in tightly encircling relationship to sealingly overlie the discharge orifice and prevent flow therethrough is a resilient tubular member. The tubular member is under significant tension so as to tightly and sealingly engage about the discharge orifice. Associated with the valve are operating means for selectively and resiliently deflecting the tubular member away from the second body portion to permit flow through the discharge orifice.

In accordance with a more limited aspect of the invention, the valve includes a housing or shield member which is joined to the body and encloses a major portion of the resilient tubular member at a location spaced outwardly thereof. Preferably, the housing member has a length such that it extends substantially to the free end portion of the second body member.

In accordance with a more limited aspect of the invention, the second body portion and the housing member are preferably cylindrical and the discharge orifice is located closely adjacent the free end of the second body portion.

In accordance with a still further object of the invention, the tubular member includes an integral loop or tab on the exterior surface thereof which is engaged by the operating member. Preferably, the operating member and loop are located such that movement of the operating member causes the tubular member to be pulled away from the second body member in an area adjacent the discharge orifice.

In accordance with a further aspect of the invention, both the first and second portions of the body member are integrally formed from a resinous plastic material and the tubular member is molded from a suitable rubber or resilient plastic material which is capable of significant elastic elongation.

A primary advantage of the invention is that the tubular member is located on the exterior of the nozzle portion of the body in a position which facilitates installation and removal.

Yet another advantage of the invention is that the relationship between the outlet orifice and the free end of the second body portion is such that when considered in conjunction with the tubular seal member, there is little or no space in which fluid can be trapped for subsequent dripping or leakage problems.

Still other benefits and advantages of the invention will become apparent to those skilled in the art upon a reading and understanding of the following detailed specification.

BRIEF DESCRIPTION OF THE DRAWINGS

The invention make take physical form in certain parts and arrangement of parts, preferred and alternate embodiments of which will be described in detail in the specification and illustrated in the accompanying drawings which form a part hereof, and wherein.

DETAILED DESCRIPTION OF THE PREFERRED EMBODIMENTS

Figure 1:
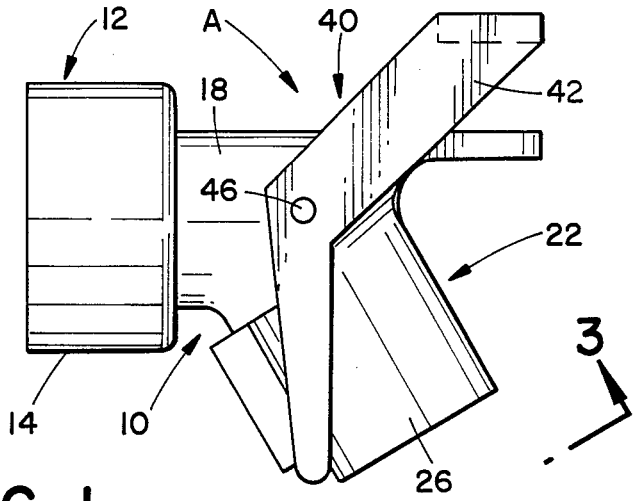
FIG. 1 is a side elevation of a first embodiment of dispensing valve assembly formed in accordance with the preferred embodiment of the subject invention.

Referring more specifically to the drawings wherein the showings are for the purpose of illustrating preferred embodiments of the invention only and not for the purpose of limiting same, FIG. 1 illustrates the overall arrangement of the preferred embodiment of a dispensing valve assembly A. While the valve assembly A is, as previously mentioned, primarily designed for and intended to be used in conjunction with the disposable bag-in-the-box or membrane type fluid containers, it will be appreciated that the valve and the inventive concepts embodied therein could equally well be used in other dispensing or valve environments for handling a variety of fluids under differing conditions. More particularly, and with specific reference to FIGS. 1 and 2, the valve assembly A of the subject embodiment generally comprises a molded plastic body 10 which includes a connecting means 12. The connecting means 12 could be of many different types but as shown as including simple threaded collar or sleeve member 1 which is adapted to join the body 12 to an associated outlet nozzle of a fluid source (not shown) such as a membrane type container. The threaded sleeve 14 is retained on the body while being permitted to have free rotation thereto by a simple collar or the like 16 carried on the body assembly 10. The body 10 could have a variety of external configurations but is illustrated as comprising a first generally cylindrical body section or portion 18 which includes a central opening 20 which extends inwardly from the connecting end of the valve assembly A. Both the connecting sleeve member 14 and the valve body 10 could be formed from many different materials using different forming processes. In the subject embodiment, however, the valve is preferably injection molded from a suitable plastic such as high density polyethylene or the like.

Figure 3:
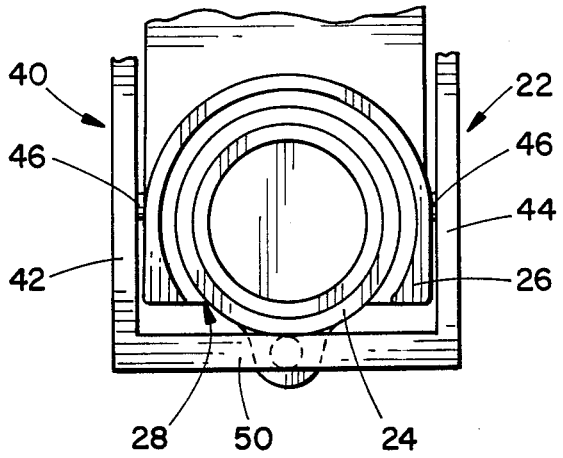
FIG. 3 is a view taken on line 3-3 of FIG. 1.

Integrally connected with the first body portion or section 18 is a second body portion indicated generally with the reference number 22. As shown in FIG. 3, the second body portion 22 is of a generally cylindrical shape and includes a first tubular or cylindrical section 24 and a second housing or outer shield section 26. Section 26 is spaced from the central cylindrical section 24 to provide a somewhat annular shaped opening or passage 28 which extends inwardly from the lower free end of body section 22. As beset shown in FIG. 3, the outer housing section 26 encompasses the upper approximately 270° of the generally circular second body portion. As will become apparent hereafter, this gives the valve the overall appearance of a typical dispensing type outlet nozzle or the like.

Although the central cylindrical portion 24 could be solid, it preferably has an opening 30 extending inwardly from the free end. The opening 30 gives the lower end of the valve the appearance of a conventional outlet faucet, tap or nozzle and reduces the quantity of material required to form the valve. Formed within the cylindrical portion 24 is a passageway 32 which joins with the opening 20 and terminates at its lower end (see FIG. 2) in a discharge orifice 34. The passageways 20 and 32 combine to provide a flow passageway means from the connecting end means 12 to the discharge orifice 34.

Figure 2:
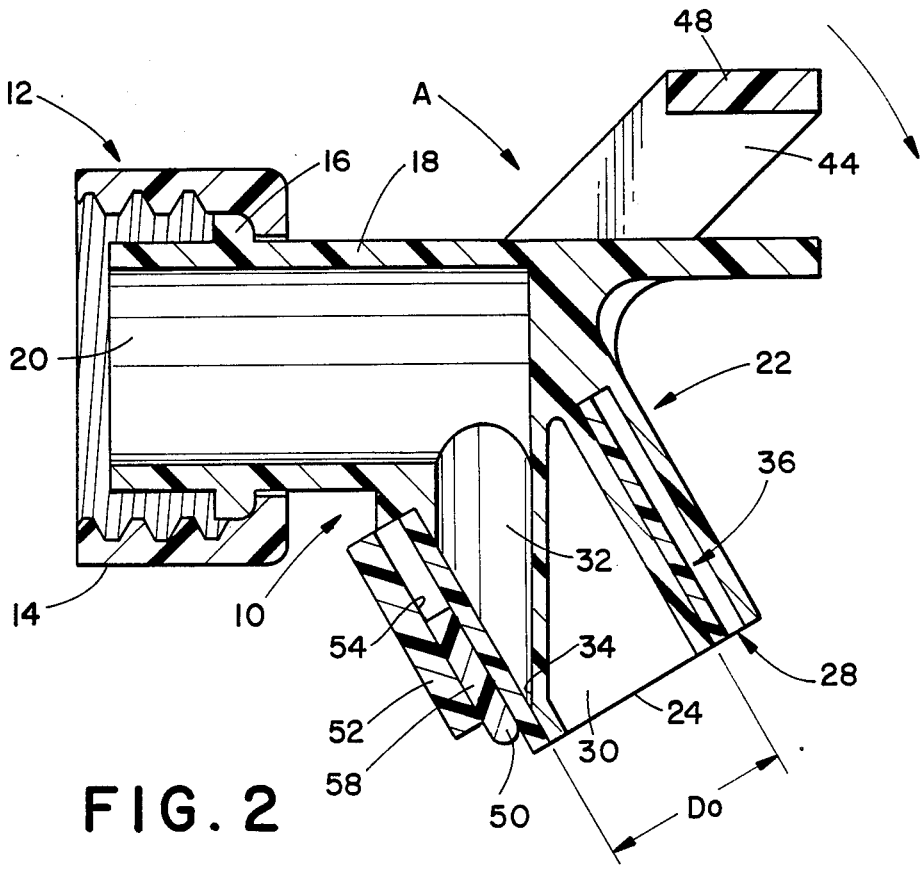
FIG. 2 is a longitudinal cross-section view of the valve shown in FIG. 1.
Figure 5:
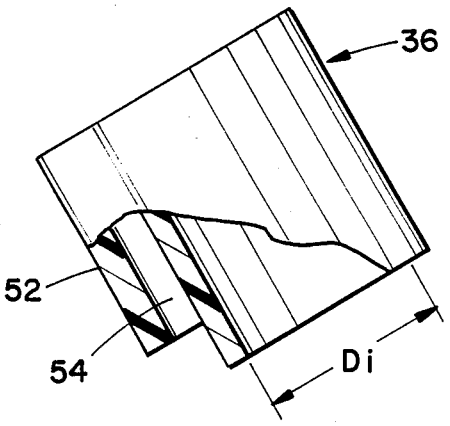
FIG. 5 is a side elevational view (partially in section) illustrating the preferred form of the tubular valve member used in the FIG. 1 embodiment.

Referring more particularly to FIGS. 2 and 5, a generally cylindrical tubular member 36 is positioned about the cylindrical second body portion 24. The tubular member 36 is preferably made from a soft, extremely resilient elastomer capable of undergoing significant elastic deformation withou taking a permanent set or rupturing. The material should have resistance to aging and permanent set and soft sealing qualities and memory properties stable across a relatively wide temperature range. The tubular seal member 36 is formed as shown in FIG. 5 and has an internal diameter $D_i$ which is significantly less than the external diameter $D_o$ of the cylindrical portion 24. The tubular member 36 is placed over the tubular member 24 as shown in FIG. 2 to tightly encircle the portion 24 and sealingly overlie the discharge nozzle 34. Preferably the tubular seal member 36 is under sufficient tension to allow it to seal against relatively high pressures within the passageway 32.

Figure 4:
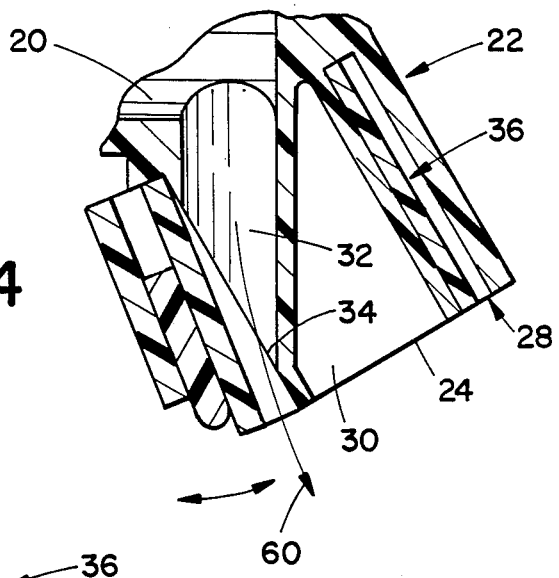
FIG. 4 is a partial cross-sectional view similar to FIG. 2 but showing the valve in an open position.

The tubular seal member 36 is arranged to be moved to an open or flow permitting position as shown in FIG. 4 by being deflected away from the member 24 at least in the area adjacent the free end of member 24 and surounding the passageway 32. Many different types of operating means could be used to produce the required selective deformation of the tubular sealing member 36. In the subject embodiment, however, the means used comprise an operating lever or handle assembly 40 (see FIGS. 2 and 3) which includes a pair of pivotally mounted side arm members 42 and 44 which are joined to the body assembly 10 by suitable pivot pins 46. The arms 42 and 44 are joined at their upper ends by a transversely extending handle or actuating portion 48. At their lower ends the arms 42 and 44 are connected by a transversely extending section 50 which is connected to the underside of the tubular seal member 36. This connection could take many forms, but in the subject embodiment, comprises an integral tab or loop 52 molded on the lower side of the tubular sealing sleeve 36 as best shown in FIGS. 2 and 5. Specifically, the loop 52 includes a central opening 54 which receives a pin like member 58 extending from the cross-piece 50 and being tightly received in the opening 54. As can be appreciated, forcing the handle portion 48 of the operating assembly in the direction shown by the arrow in FIG. 2 causes the tubular sealing sleeve 36 to be pivoted or pulled away from the member 24 as best shown in FIG. 4. This produces an opening of the orifice 34 and permits flow to take place as shown by the arrow 60.

As can be seen from the foregoing, the subject valve is extremely simple in construction. Installation or removal of the tubular seal member 36 is simplfied because it is externally accessible. To facilitate removal and installation the handle assembly 40 is preferably formed in a manner to permit its ready removal fromm the valve assembly, such as by lateral deflection of the arms 42, 44 off the pivot pins 46. Similarly, it is, of course, possible to make the housing or shield member 26 removable to provide further access to the seal member 36.

Figure 6:
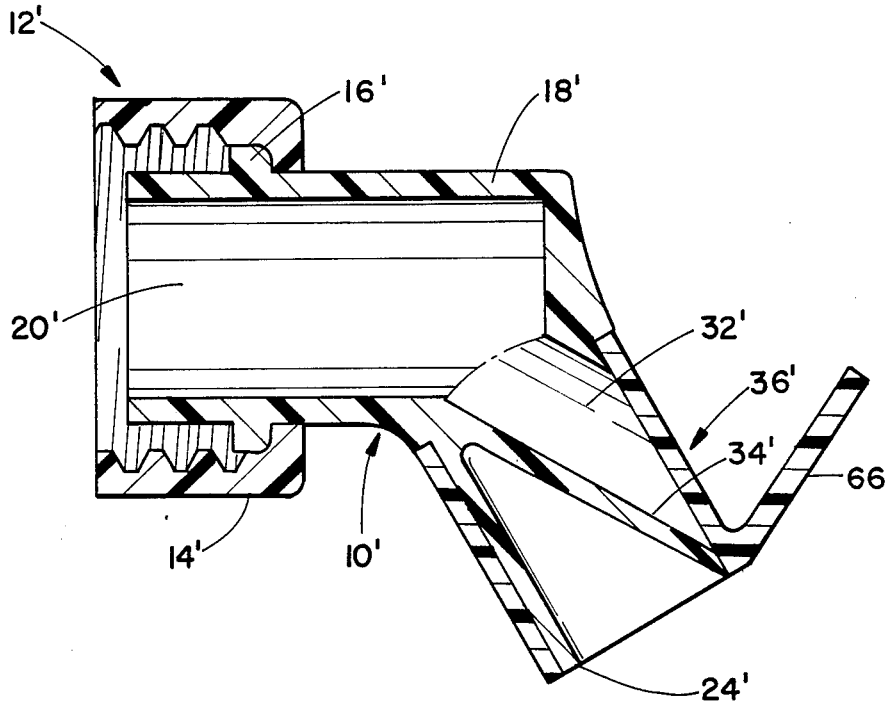
FIG. 6 is a longitudinal cross-sectional view of a second embodiment of a dispensing valve assembly formed in accordance with the invention.

FIG. 6 illustrates a second embodiment of dispensing valve formed in accordance with the invention. In this embodiment like reference numerals differentiated by a prime (') suffix have been used to identify the same or similar elements. Elements so identified are to be considered as the same as the corresponding element of the FIG. 1 embodiment unless otherwise noted. More particularly, in this embodiment, passageway 32' extends from central opening 20' to an outlet or discharge orifice 34' located on the upper section of the cylindrical second body portion 24'. The tubular seal member 36' surrounds body portion 24' and sealingly overlies the discharge orifice 34'.

The operating means for pulling the tubular sealing member 36' away from the orifice 34' to permit flow to take place comprises a tab or handle portion 66. Preferably, the handle portion 66 is formed integrally with the sealing member 36', as shown.

The invention has been described with reference to preferred and alternate embodiments. Obviously, modifications and alterations will occur to others upon the reading and understanding of this specification. It is intended to include all such modifications and alterations insofar as they come within the scope of the appended claims or the equivalents thereof.

What is claimed is:

1. A manually operable dispensing valve comprising:

a body member including connecting means for connecting the body member to a fluid supply source, said body member including an elongated relatively rigid body portion extending outwardly from the connecting means and terminating in a free end:

a laterally opening discharge orifice in the rigid body portion adjacent the free end thereof and a fluid passageway extending through the body member for conducting fluid from the supply source to the discharge orifice;

a resilient tubular member positioned over the rigid body portion in tensioned surrounding relationship thereto to sealingly overlie the discharge orifice;

operating means for deflecting the tubular member away from the orifice to permit fluid flow therethrough, said operating means comprising an operating lever pivotally mounted on the body member and having an end joined to the tubular member at a location exterior of the body adjacent the discharge orifice to selectively deflect the tubular member away from the outlet orifice upon actuation of the lever.

2. A dispensing valve as defined in claim 1 wherein the relatively rigid body portion is cylindrical.

3. A dispensing valve as defined in claim 1 including a relatively rigid housing carried by the body portion and enclosing the resilient tubular member, the housing being open in the area radially aligned with the outlet orifice to permit deflection of the tubular member away from the outlet orifice while the housing is in place thereon.

4. A dispensing valve as defined in claim 3 wherein the housing encloses the resilient tubular member throughout a circumferential extent of greater than 180°.

* * * * *